US010071489B2

(12) United States Patent
MacNair et al.

(10) Patent No.: US 10,071,489 B2
(45) Date of Patent: Sep. 11, 2018

(54) LOCKING FOLDING KNIFE

(71) Applicant: Kai U.S.A., Ltd., Tualatin, OR (US)

(72) Inventors: James MacNair, Newberg, OR (US); Timothy James Galyean, Newberg, OR (US); Craig Donald Kemp Green, Newberg, OR (US)

(73) Assignee: KAI U.S.A., Ltd., Tualatin, OR (US)

( * ) Notice: Subject to any disclaimer, the term of this patent is extended or adjusted under 35 U.S.C. 154(b) by 269 days.

(21) Appl. No.: 14/837,995

(22) Filed: Aug. 27, 2015

(65) Prior Publication Data

US 2015/0367520 A1 Dec. 24, 2015

Related U.S. Application Data

(63) Continuation-in-part of application No. 13/351,056, filed on Jan. 16, 2012, now Pat. No. 9,120,234.

(60) Provisional application No. 61/433,917, filed on Jan. 18, 2011, provisional application No. 61/582,057, filed on Dec. 30, 2011.

(51) Int. Cl.
*B26B 1/04* (2006.01)

(52) U.S. Cl.
CPC ..... *B26B 1/044* (2013.01)

(58) Field of Classification Search
CPC ..... B26B 1/044; B26B 1/04; B26B 1/042; B26B 1/00; B26B 1/02; B26B 1/046; B26B 1/048; B26B 1/06; B26B 1/08; B26B 1/10
USPC ..... 30/151–161, 330–331, 337–339; 7/118–120
See application file for complete search history.

(56) References Cited

U.S. PATENT DOCUMENTS

| | | | | |
|---|---|---|---|---|
| 1,478,260 | A | 12/1923 | Sibley | |
| 4,489,493 | A * | 12/1984 | Tsumura | B27B 17/025 30/387 |
| 5,327,651 | A * | 7/1994 | Favreau | B26B 1/042 30/161 |
| 5,755,035 | A | 5/1998 | Weatherly | |
| 5,964,035 | A | 10/1999 | Poehlman | |
| 6,101,723 | A * | 8/2000 | Ford | B26B 1/044 30/157 |
| 6,101,724 | A | 8/2000 | Halligan | |
| 6,668,460 | B2 | 12/2003 | Feng | |
| 7,032,315 | B1 * | 4/2006 | Busse | B26B 1/048 30/153 |
| 7,059,053 | B2 * | 6/2006 | Sakai | B26B 1/048 30/160 |
| 7,062,856 | B2 | 6/2006 | Moser | |
| 7,694,421 | B2 * | 4/2010 | Lin | B26B 1/046 30/159 |

(Continued)

OTHER PUBLICATIONS

ISA Korean Intellectual Property Office, International Search Report and Written Opinion Issued in Application No. PCT/US2016/048449, dated Dec. 15, 2016, WIPO, 12 pages.

(Continued)

*Primary Examiner* — Ghassem Alie
(74) *Attorney, Agent, or Firm* — Alleman Hall Creasman & Tuttle LLP

(57) ABSTRACT

A folding knife includes a lockbar for automatically locking a knife blade in an opened position relative to a handle. A puck attached to the lockbar is configured to engage a tang of the blade to lock the blade in an open position relative to the handle.

19 Claims, 14 Drawing Sheets

(56) References Cited

U.S. PATENT DOCUMENTS

| | | | | |
|---|---|---|---|---|
| 7,774,940 | B2 * | 8/2010 | Frank | B26B 1/044 30/155 |
| 9,327,413 | B2 * | 5/2016 | Sakai | B26B 1/042 |
| 2002/0066187 | A1 * | 6/2002 | Jennings | B26B 1/044 30/161 |
| 2003/0131478 | A1 | 7/2003 | Feng | |
| 2004/0045170 | A1 * | 3/2004 | Glesser | B26B 1/04 30/161 |
| 2004/0261272 | A1 | 12/2004 | Moser | |
| 2006/0162168 | A1 | 7/2006 | Kao | |
| 2009/0119926 | A1 | 5/2009 | Nenadic | |
| 2010/0313427 | A1 | 12/2010 | Hsu | |
| 2011/0119926 | A1 | 5/2011 | Klecker | |
| 2012/0180321 | A1 | 7/2012 | MacNair et al. | |
| 2015/0128426 | A1 | 5/2015 | Sakai | |

OTHER PUBLICATIONS

"SiDiS . . . or there are things in the order of magnitude higher . . . ," Forum post on Guns.ru, Available at http://forum.guns.ru/forummessage/5/626540-5.html, May 2, 2010, 16 pages.

European Patent Office, Extended European Search Report Issued in Application No. 16840055.4, dated May 11, 2018, Germany, 6 pages.

* cited by examiner

LOCKING FOLDING KNIFE

CROSS REFERENCE TO RELATED APPLICATIONS

This application is a continuation-in-part of U.S. application Ser. No. 13/351,056, filed Jan. 16, 2012, which claims priority to U.S. Provisional Application No. 61/433,917, filed Jan. 18, 2011, and U.S. Provisional Application No. 61/582,057, filed Dec. 30, 2011. These applications are incorporated by reference in their entirety for all purposes.

SUMMARY

A folding knife includes a lockbar for automatically locking a knife blade in an opened position relative to a handle. A puck attached to the lockbar is configured to engage a tang of the blade to lock the blade in an open position relative to the handle.

DETAILED DESCRIPTION

Figure 1:
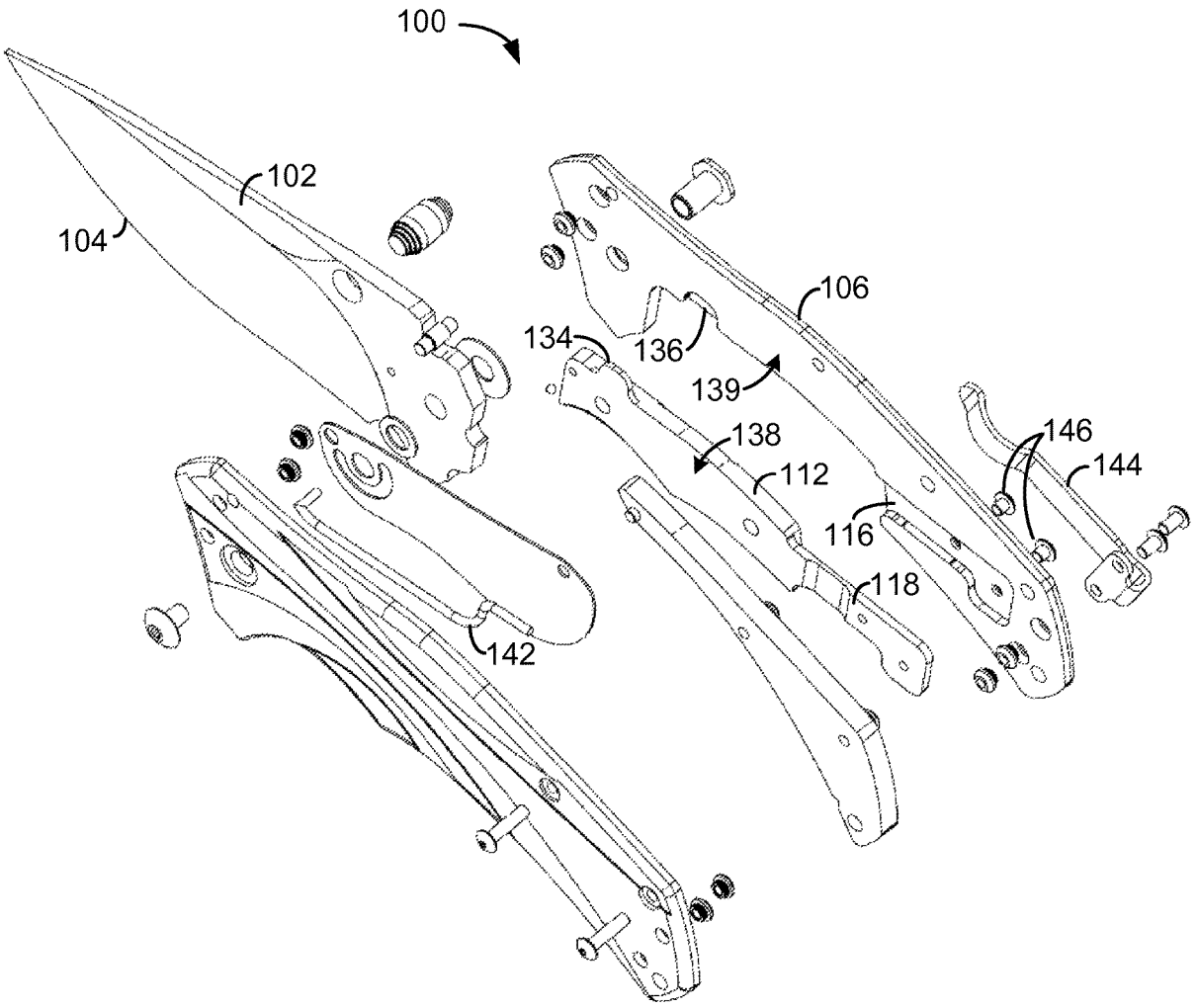
FIG. 1 is an exploded view of an example folding knife in accordance with an embodiment of the present disclosure.

FIG. 1 shows an exploded view of a folding knife 100 in accordance with an example embodiment of the present disclosure. Knife 100 includes a blade 102 with a cutting edge 104. Blade 102 is pivotally connected to a back handle 106 in a manner that allows the blade to pivot between opened and closed positions. When pivoting, blade 102 remains in a folding plane that is orthogonal to a pivot axis.

Figure 2A:
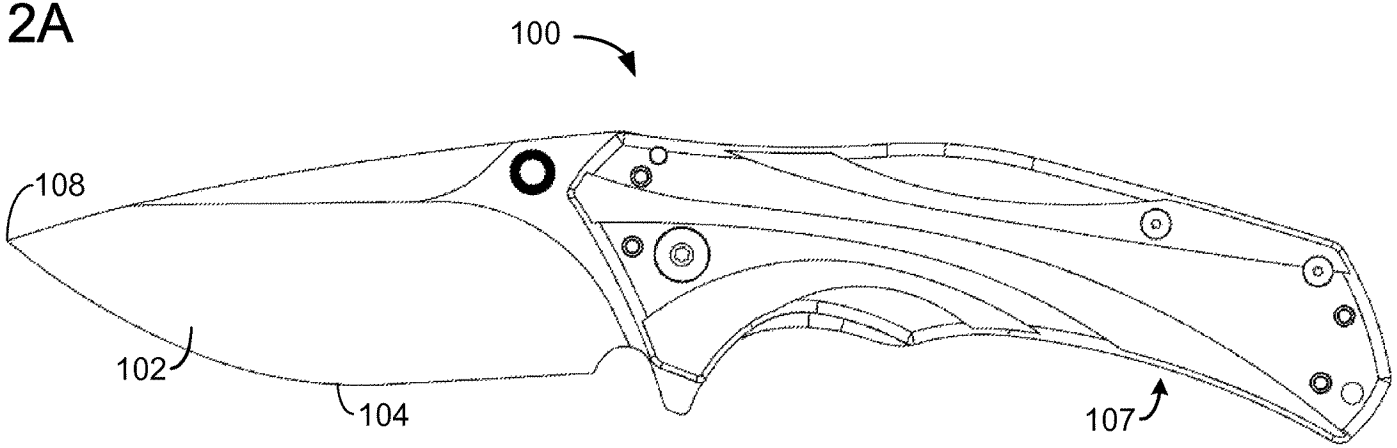
FIGS. 2A and 2B are plan views showing the knife of FIG. 1 in an opened position.
Figure 2B:
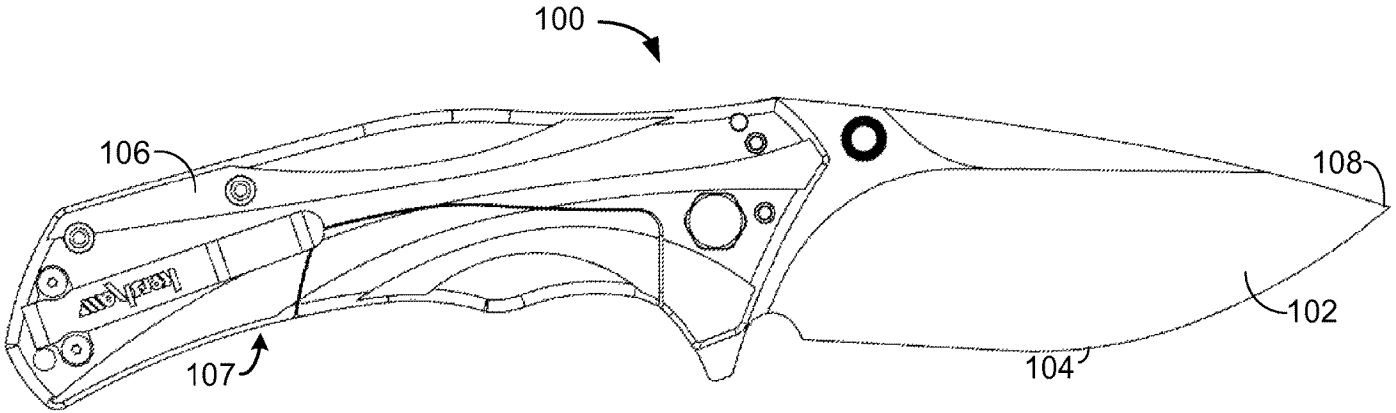
Figure 3A:
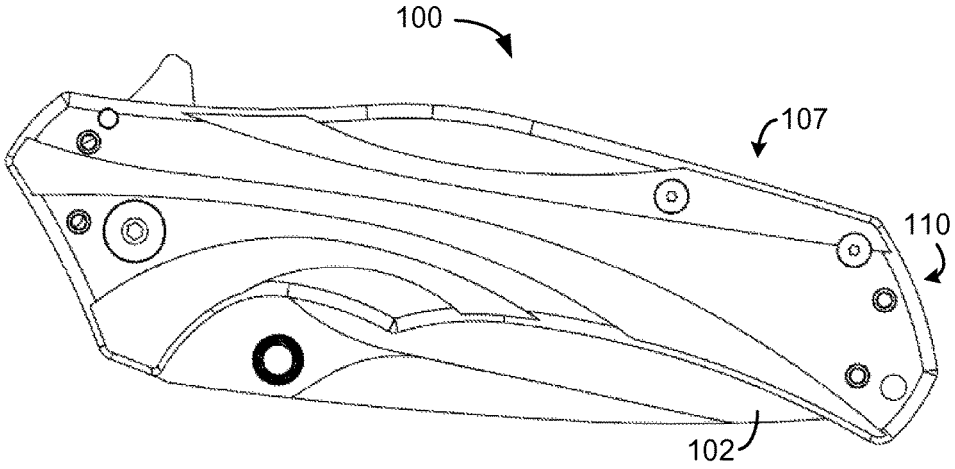
FIGS. 3A and 3B are plan views showing the knife of FIG. 1 in a closed position.
Figure 3B:
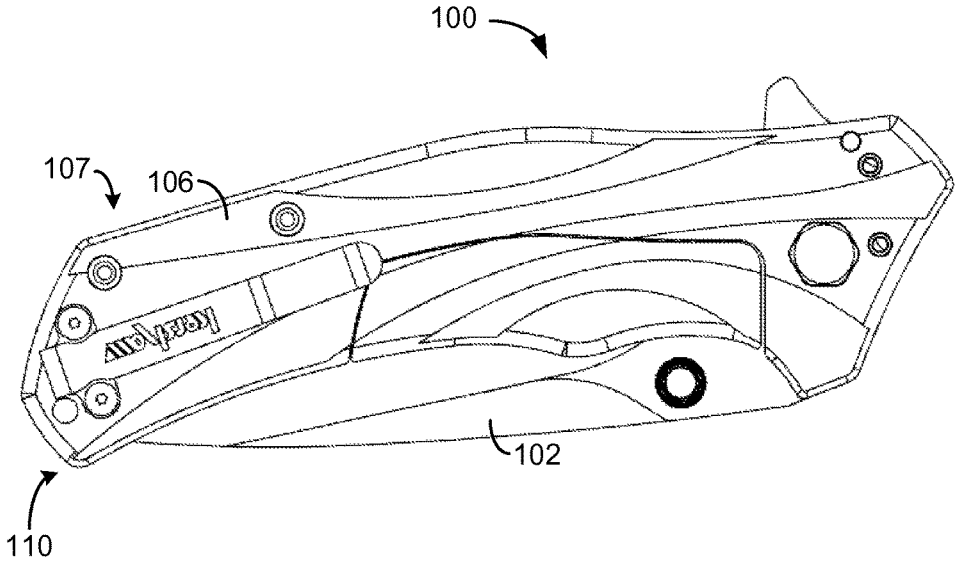

FIGS. 2A and 2B show knife 100 in an opened position. When opened, cutting edge 104 of blade 102 is exposed with a tip 108 of the blade extending away from a handle 107. FIGS. 3A and 3B show knife 100 in a closed position. When closed, the cutting edge of blade 102 is protected by handle 107, and the tip of blade 102 is proximate a non-pivoting end 110 of handle 107.

Figure 4A:
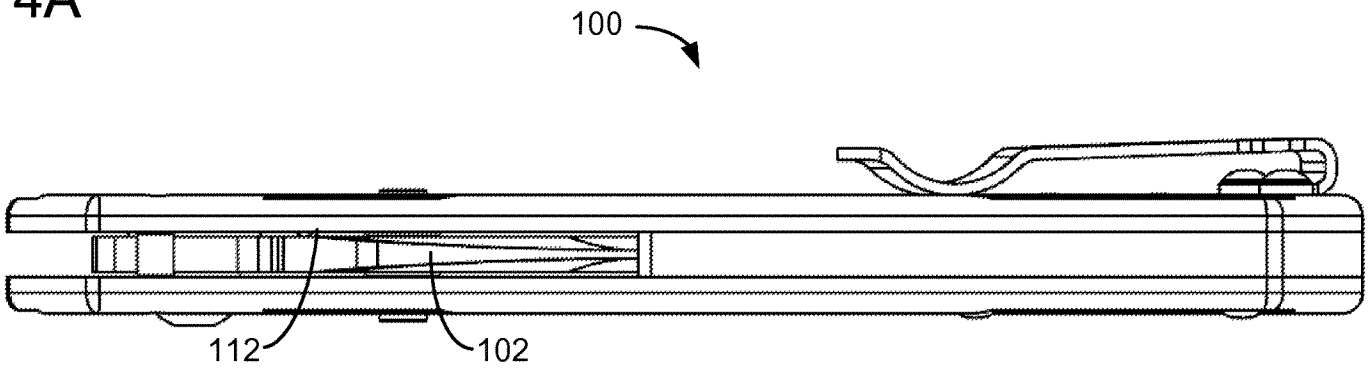
FIGS. 4A and 4B are elevation views showing the knife of FIG. 1 in a closed position.
Figure 4B:
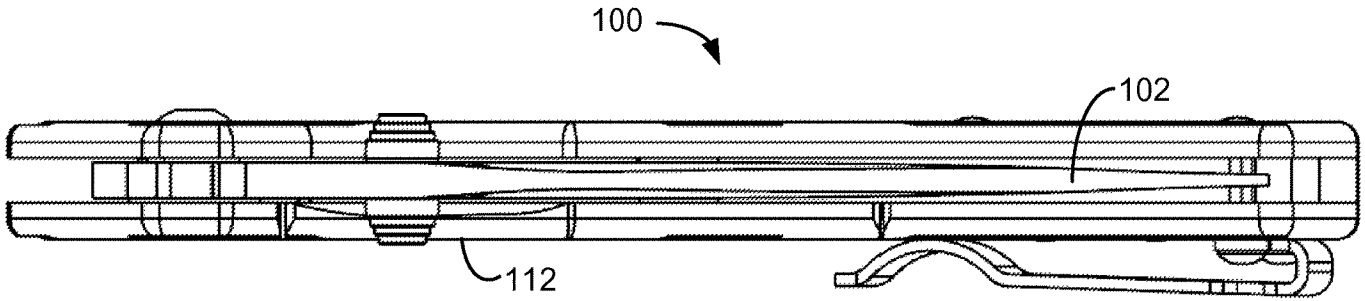

Returning to FIG. 1, knife 100 includes a lockbar 112 that is configured to automatically lock the knife in the opened position when the blade is pivoted to the opened position. As shown in FIGS. 4A and 4B, lockbar 112 is out of the folding plane of blade 102 when the knife is in the closed position. However, the lockbar is biased towards the blade. As such, only the presence of the blade in the closed position keeps the lockbar from moving into the folding plane of the blade. When blade 102 is pivoted to the opened position and out of the way of the lockbar, the biasing of the lockbar causes the lockbar to move into the folding plane of the blade.

Figure 5A:
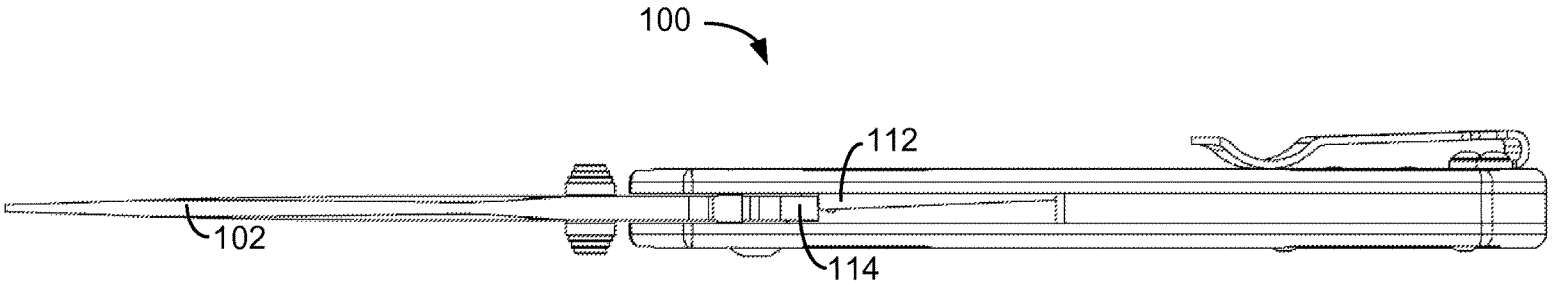
FIGS. 5A and 5B are elevation views showing the knife of FIG. 1 in an opened position.
Figure 5B:
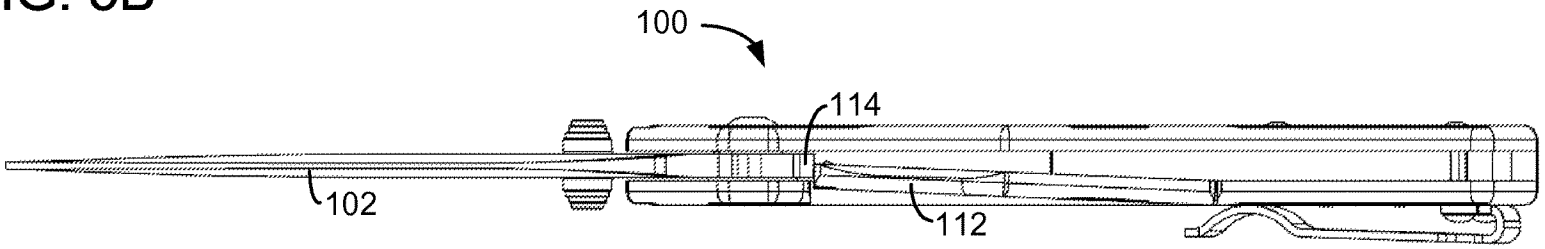

FIGS. 5A and 5B show the lockbar 112 engaging a tang 114 of blade 102. With the lockbar in the folding plane of the blade and engaging the tang of the blade, the blade is unable to pivot to the closed position—i.e., the knife blade is locked in the opened position. As such, in order to close the knife, the lockbar may be manually moved out of the folding plane so as not to engage the tang of the blade. While the lockbar is held against its bias so as not to engage the tang, the blade may be manually pivoted back to the closed position. After being returned to the closed position, the blade prevents the lockbar from moving back into the folding plane of the blade.

In some examples, folding knives, including but not limited to knife 100, may include a lockbar that is a separate piece than the handle. Because the lockbar and the handle are separate pieces, the lockbar may be made from a different material than the handle. In particular, it may be desirable to construct the handle from a material that is relatively lighter than the material(s) that is/are used to construct the lockbar. In this way, the overall weight of the knife can be decreased, while the overall strength and wear characteristics of the lockbar remain adequate for locking the blade in the opened position. Nonlimiting examples of suitable materials for the handle include, but are not limited to, carbon fiber, plastic, titanium, and aluminum. Nonlimiting examples of suitable materials for the lockbar include, but are not limited to, steel, aluminum, and titanium.

As a nonlimiting example, FIG. 1 shows lockbar 112 detachably connectable to back handle 106. The lockbar may be connected to the back handle 106, and/or another portion of the handle, in any suitable manner. In the illustrated example, FIG. 1 shows two lockbar attachment screws 146 that fasten the lockbar 112 to the back handle 106. However, other fastening mechanisms may be used without departing from the scope of this disclosure. As nonlimiting examples, rivets or adhesives may be used.

The portion of the handle to which the lockbar is connected may be shaped so as to at least partially mate with the lockbar. As a nonlimiting example, FIG. 1 shows a pocket 116 formed in back handle 106. Pocket 116 is shaped with the same profile as a tail portion 118 of lockbar 112. Further, pocket 116 is shaped with approximately the same depth as the thickness of tail portion 118.

Figure 6A:
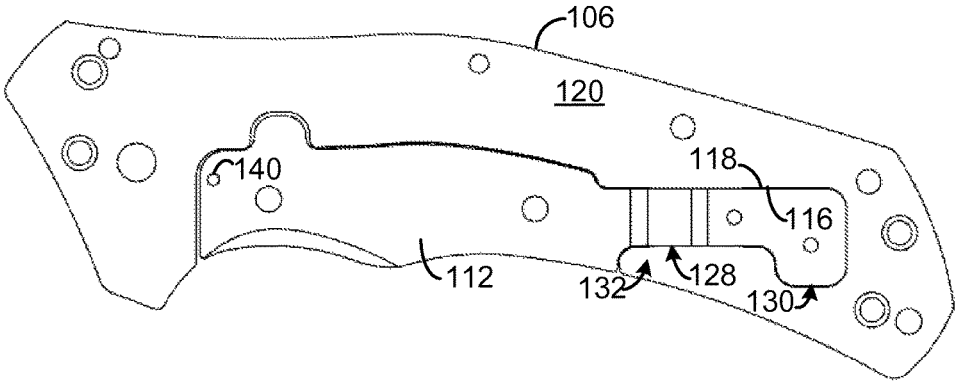
FIGS. 6A and 6B are plan views showing the back handle and lockbar of the knife of FIG. 1.
Figure 6B:
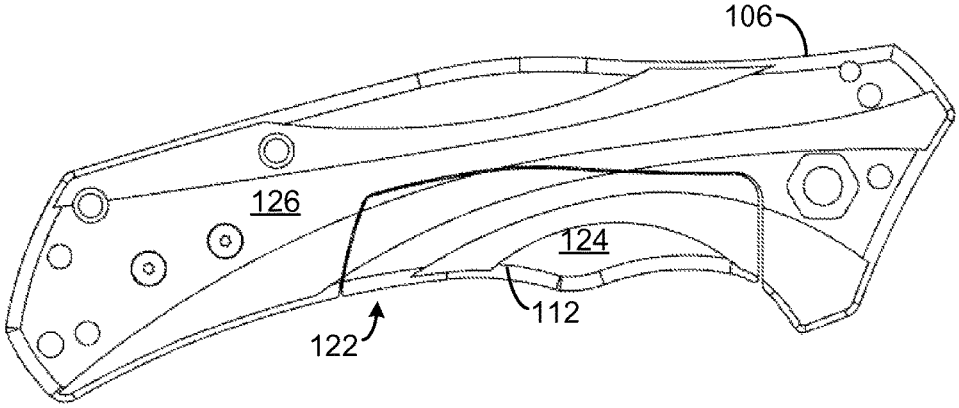

As illustrated in FIG. 6A, when tail portion 118 is fit into pocket 116, there is little to no gap between the sidewalls of the tail portion and the sidewalls of the pocket. In this way, the pocket mechanically secures the lockbar in place. Furthermore, when the tail portion of the lockbar is fit into the pocket, the tail portion is substantially flush with the inside surface 120 of back handle 106. Moreover, as shown in FIG. 6B, the thickness of a head portion 122 of lockbar 112 may be substantially the same as a thickness of back handle 106. In this way, the visible portion 124 of the lock bar is substantially flush with the outside surface 126 of the back handle when the blade is in the closed position. In other embodiments, the pocket may be sized to accommodate the entire lockbar so that the handle effectively hides the lockbar from view.

Pocket 116 and tail portion 118 are provided as nonlimiting examples. Other knives within the scope of this disclosure may include differently shaped pockets and tail portions. In some embodiments, the tail portion of a lockbar may include a relatively narrow neck portion and a relatively wide end portion. FIG. 6A shows an example narrow neck portion 128 and wide end portion 130. In some embodiments, the pocket may be defined by a handle portion that spaces the pocket from an edge of the handle, thus creating a wrap-around pocket. FIG. 6A shows an example handle portion 132 that creates such a wrap-around pocket 116.

Single-piece and multi-piece lockbars may be used without departing from the scope of this disclosure. FIG. 1 shows a nonlimiting example of a single-piece lockbar 112.

Figure 7:
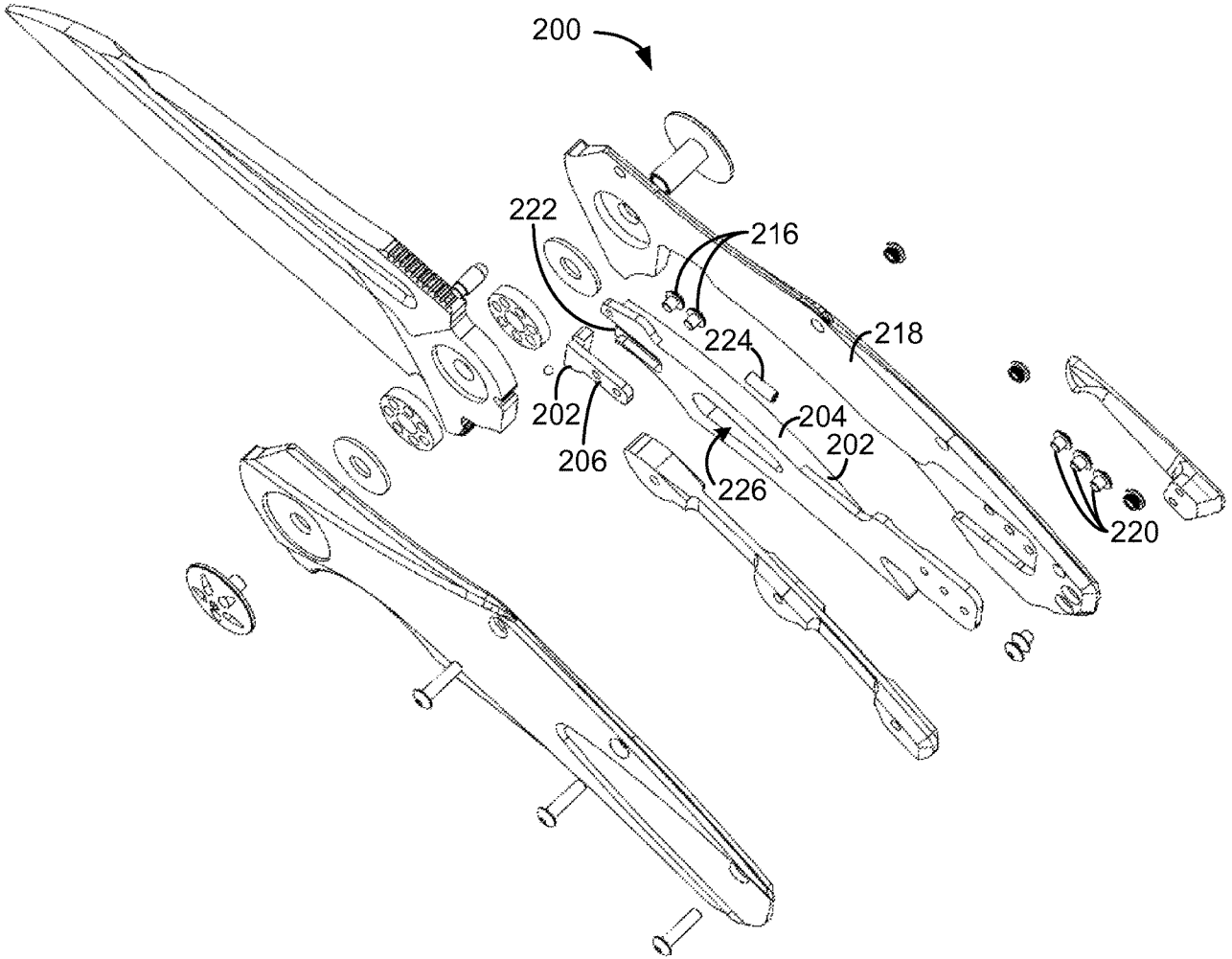
FIG. 7 is an exploded view of another example folding knife in accordance with another embodiment of the present disclosure.

FIG. 7 shows an exploded view of a folding knife 200 in accordance with another example embodiment of the present disclosure. Knife 200 is a nonlimiting example of a knife including a multi-piece lockbar 202. In particular, multi-piece lockbar 202 includes an arm 204 and a puck 206. Like the single-piece lockbar described above, the arm includes a tail portion and a head portion, and the tail portion includes a relatively narrow neck portion and a relatively wide end portion. However, unlike the single-piece lockbar described above, arm portion 204 of multi-piece lockbar 202 does not directly engage the tang of the knife blade. Instead, puck 206 engages the tang.

Multi-piece lockbars that include a separate puck for engaging the tang of the blade may be variably connected to the arm so that the position of the puck relative to the tang can be adjusted. In the embodiment illustrated in FIG. 7, puck 206 is connected to arm 204 by two lockbar puck attachment screws 216. Arm 204 is detachably connected to back handle 218 by three lockbar attachment screws 220.

Arm 204 has a pocket 222 into which puck 206 fits. The position of puck 206 within pocket 222 may be tuned, and the lockbar puck attachment screws 216 may be used to secure the puck in the tuned position. In the illustrated embodiment, a set screw 224 that is accessible via an opening 226 in arm 204 may be adjusted to tune the position of puck 206.

In other embodiments, the puck may be configured to move in a substantially linear direction via one or more screws configured to slide in one or more grooves. The motion of the puck in said embodiments may be limited via one or more set screws.

After the puck and/or blade tang wear from use, the position of the puck relative to the arm may be adjusted so that the puck properly engages the tang to provide a secure lock when the blade is opened. In other embodiments, a position of a single-piece or multi-piece lockbar relative to a handle may be tuned in order to move a tang engagement surface of the lockbar into the proper position for locking the blade in an opened position. In other words, the entire lockbar may be adjusted relative to the handle as opposed to a puck of a multi-piece lockbar being adjusted relative to the arm of a multi-piece lockbar. In such embodiments, the pocket may be sized and shaped to accommodate changing the position of the lockbar relative to the handle.

For example, the lockbar may be configured to be adjustable via one or more set screws. In addition, the motion of the lockbar may be limited via adjustment of a threaded shaft. In another embodiment, a folding knife may include an adjustable pocket. The position of the pocket may be adjusted in one or more directions via one or more set screws.

In some embodiments, the arm of a multi-piece lockbar may be constructed from a material that is relatively lighter than the material used to construct the puck of the multi-piece lockbar. Because only the puck engages the tang, the material from which the arm is constructed need not possess the same wear characteristics as the puck. By constructing the arm from a lighter material than the puck, the overall weight of the knife may be further reduced.

Figure 8:
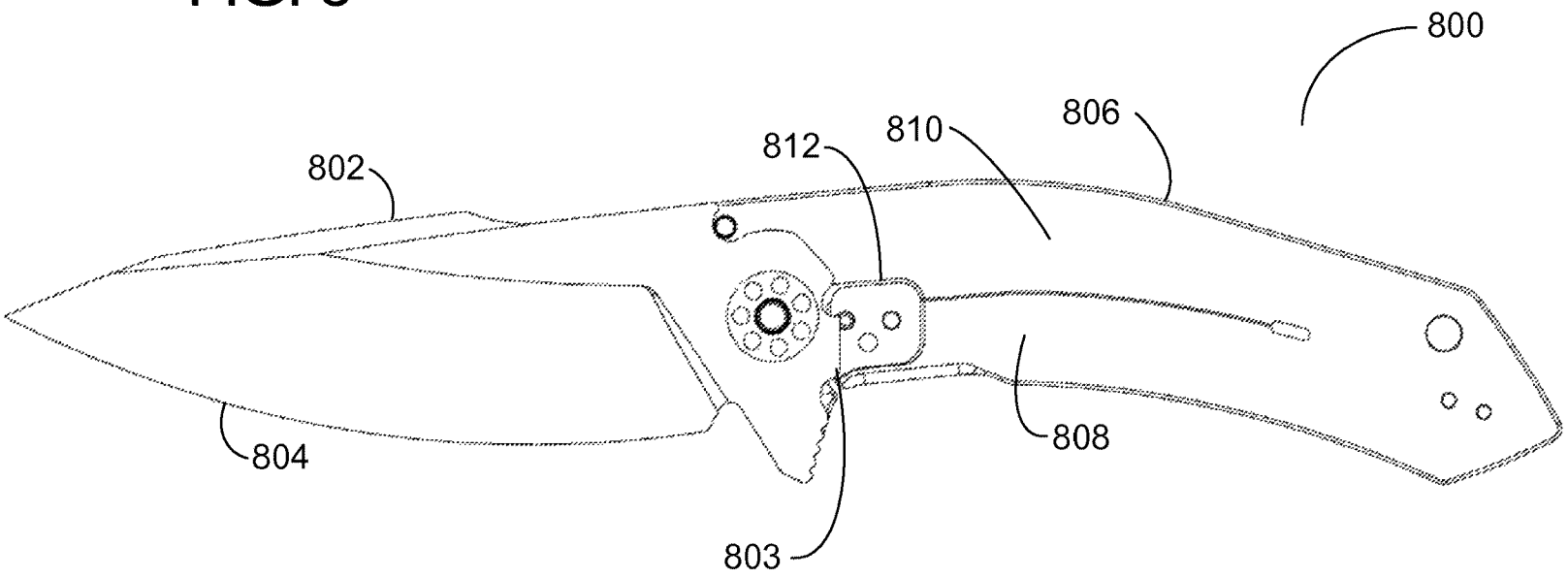
FIG. 8 is a plan view of a portion of another example folding knife in accordance with another embodiment of the present disclosure.

FIG. 8 shows a plan view of a portion of a folding knife 800 in accordance with another embodiment of the present disclosure. Folding knife 800 includes a blade 802 with a tang 803 and a cutting edge 804. Blade 802 is pivotally connected to a first handle piece 806 on one side of the blade. Folding knife 800 further includes a second handle piece on another side of the blade, not shown in FIG. 8. Blade 802 is affixed to the two handle pieces in a manner that allows the blade to pivot between opened and closed positions. When pivoting, blade 802 remains in a folding plane that is orthogonal to a pivot axis.

Folding knife 800 further includes lockbar 808. In contrast to the previous embodiments given above, lockbar 808 is an integral portion of the first handle piece 806. As such, first handle piece 806 may comprise two portions, lockbar 808 and support portion 810. First handle piece 806 may therefore be constructed of a single piece of material including both lockbar 808 and support portion 810. Nonlimiting examples of suitable materials for the first handle piece 806 include, but are not limited to, carbon fiber, plastic, and/or metal (e.g., titanium, aluminum, and/or other suitable metals).

Additional features not shown in FIG. 8, including but not limited to screws, bolts, fasteners, accessories, and/or clips may be attached to or integrally constructed with first handle piece 806 and/or the second handle piece. These additional structures may be constructed from different materials from the first and second handle pieces.

In the illustrated example, lockbar 808 is an integral portion of first handle piece 806, in contrast to the embodiments described above in which the handle and lockbar are separate pieces. However, similar to the above embodiments, lockbar 808 is biased toward a folding plane of blade 802. As a result, when blade 802 is in a closed position, lockbar 808 runs substantially parallel to the folding plane of blade 808. However, when blade 802 is pivoted to an open position, blade 802 vacates the space between the first and second handle pieces, allowing lockbar 808 to move into the open space (i.e., into the folding plane of the blade), according to its bias.

Lockbar 808 further includes a puck 812 attached to an end of lockbar 808 and configured to lock blade 802 in an open position. When blade 802 is in an open position, and lockbar 808 is occupying the folding plane of the blade 802, puck 812 interfaces with blade tang 803, effectively locking blade 802 in place. In order to return blade 802 to its closed position, lockbar 808 can be manually moved out of the folding plane of the blade, thereby disengaging the puck 812 from the tang 803, and allowing blade 802 to be manually moved back into its closed position.

In some embodiments, puck 812 may be separate from lockbar 808, and may further be designed to withstand substantial wear from tang 803. As such, puck 812 may be constructed from a different material than first handle piece 806. For instance, the material of puck 812 may be harder than the material of lockbar 808. By using the relatively hard material for only the puck, as opposed to the entire lockbar, the weight and/or material costs of folding knife 800 may be reduced without compromising the overall strength and wear characteristics of the locking mechanism. Further, the second handle piece optionally may be constructed from a different material, which may be relatively lighter/heaver, harder/softer, and/or more or less durable than the material of first handle piece 806, and/or puck 812.

Figure 9:
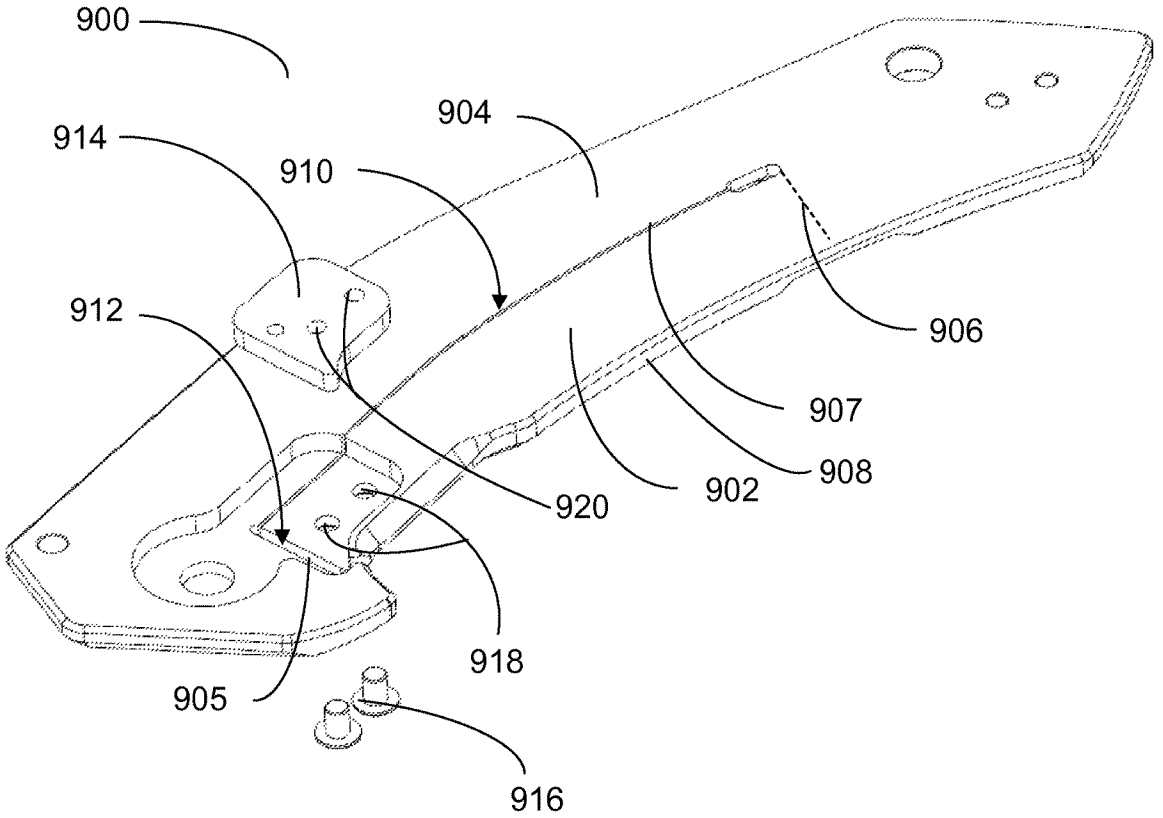
FIG. 9 is an exploded view of an example back handle assembly.

FIG. 9 shows an exploded view of an example first handle piece 900 useable with folding knives including, for example, folding knife 800. First handle piece 900 includes lockbar 902 and support portion 904, which are integral portions of first handle piece 900, being constructed from the same piece of material. Lockbar 902 includes a puck-attachment end 905 proximate the blade tang (not shown), and a flexion end 906 opposite the puck-attachment end 905. Lockbar 902 additionally includes a support-proximate edge 907 proximate to support portion 904, and a support-opposite edge 908 opposite to support portion 904. The flexion end 906 is continuous with and extends from the support portion 904 of the first handle piece 900. A first gap 910 separates the lockbar 902 from the support portion 904 between the puck-attachment end 905 and the flexion end 906. A second gap 912 separates the lockbar 902 from the support portion 904 at the puck-attachment end 905 between the support-proximate edge 907 and the support-opposite edge 908.

First handle piece 900 may be constructed such that lockbar 902 is biased toward a folding plane of a blade. Any suitable method, process, and/or other technique may be used in order to bias lockbar 902. For example, first handle piece 900 may be bent and/or curved in the vicinity of flexion end 906, biasing lockbar 902 toward the folding plane of the blade. Such bending and/or curving may occur at any stage of the construction of first handle piece 900. Further, as shown in FIG. 9, the thickness of first handle piece 900 may be relatively reduced around flexion end 906. It may be easier to bias lockbar 902 toward the folding plane of the blade, and/or to manually bend or flex lockbar 902 away from the folding plane of the blade during blade closing, when flexion-end 906 is thinner than surrounding portions of first handle piece 900.

First handle piece 900 additionally includes puck 914, and fasteners connecting puck 914 to lockbar 902. In the case of FIG. 9, these fasteners are shown as pin fasteners 916. Pin fasteners 916 may be inserted through lockbar attachment holes 918 and puck attachment holes 920, thereby attaching puck 914 to lockbar 902.

While FIG. 9 shows two pin fasteners 916, as well as two corresponding lockbar and puck attachment holes 918 and 920, any number of pin fasteners and corresponding attachment holes can be used to attach puck 914 to lockbar 920. For example, folding knife 800 could incorporate three pin fasteners, or only one pin fastener, without departing from the scope of this disclosure. It will be further appreciated that while FIG. 9 shows pin fasteners 916 configured for insertion first through lockbar attachment holes 918 and second through puck attachment holes 920, this is not limiting. An alternate first handle piece 900 could be constructed in which pin fasteners 916 are inserted first through puck attachment holes 920 and second through lockbar attachment holes 918. In such an embodiment, the puck may include recesses into which the fastener heads may be sunk.

Further, pin fasteners 916 are not limited to the specific shape/configuration/design shown in FIG. 9, and may in other embodiments take on virtually any suitable form. For example, pin fasteners 916 may comprise screws, bolts, pins, nails, and/or rivets, among other potential fasteners, and may include threads, grooves, notches, and/or magnetic properties, among other potential fastening methods.

Figure 10:
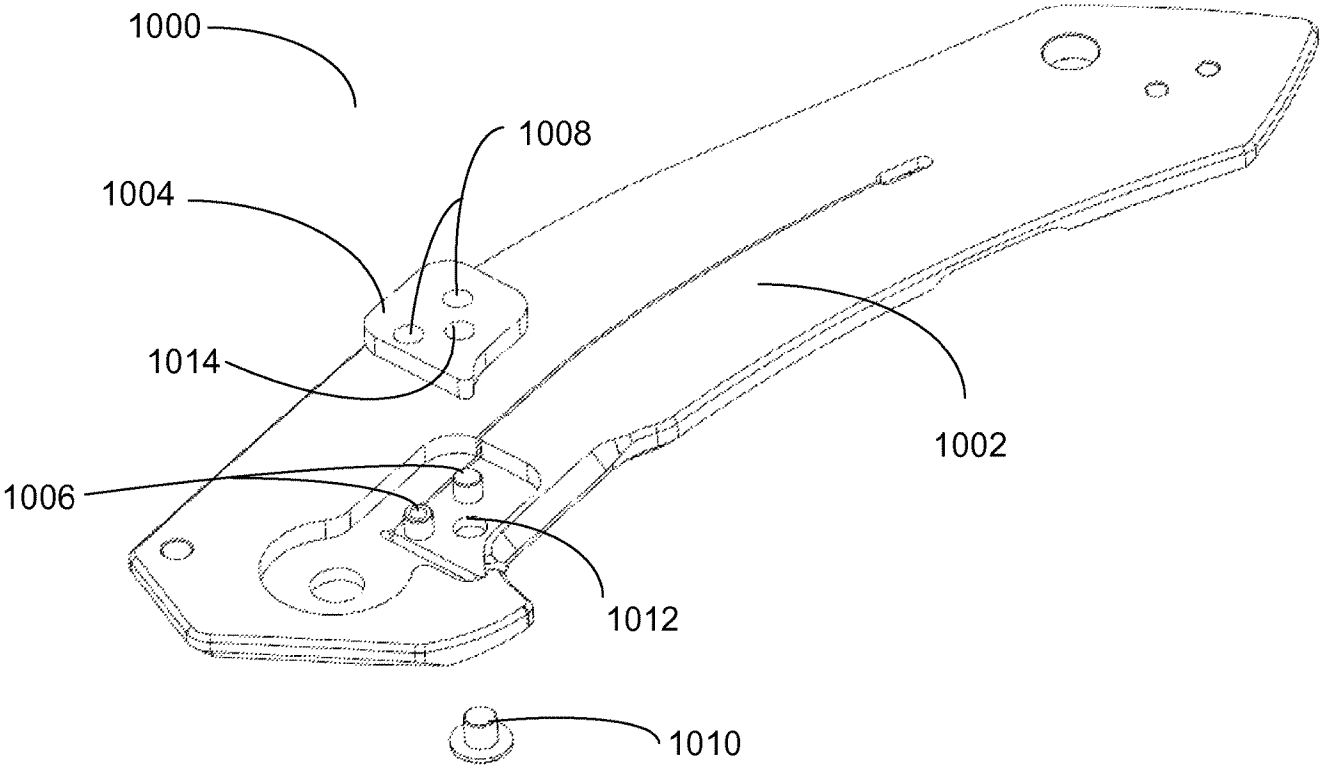
FIG. 10 is an exploded view of another example back handle assembly.

FIG. 10 shows an exploded view of an example first handle piece 1000, usable with folding knives including, for example, folding knife 800. First handle piece 1000 includes lockbar 1002 and puck 1004. Similar to first handle piece 900, first handle piece 1000 includes fasteners connecting the puck 1004 to the lockbar 1002. However, as shown in FIG. 10, puck 1004 is attached via location posts 1006 as well as pin fastener 1010. As pictured, location posts 1006 are an integral part of lockbar 1002. During puck attachment, location posts 1006 may be inserted into receiving holes 1008 on puck 1004, while pin fastener 1010 is inserted through lockbar attachment hole 1012 and puck attachment hole 1014.

In some embodiments, location posts 1006 may serve as a guide for puck attachment. For example it may be easier for a user or manufacturer to attach puck 1004 to lockbar 1002 after location posts 1006 have already been inserted into receiving holes 1008, as puck 1004 will be less likely to slip out of place during pin fastener 1010 insertion. Furthermore, location posts 1006 may include one or more additional properties which contribute to the attachment of puck 1004 to lockbar 1002. For example, location posts 1006 may incorporate one or more grooves, threads, notches, magnetic properties, and/or other fastening features, in order to more securely attach puck 1004 to lockbar 1002.

While FIG. 10 shows two location posts 1006 and a single pin fastener 1010, along with holes 1008, 1012, and 1014, any suitable fastening methods may be used for attaching puck 1004 to lockbar 1002. In other embodiments, first handle piece 1000 could be constructed to incorporate any number of location posts and pin fasteners, along with the corresponding holes, and/or any other suitable fasteners. As a nonlimiting example, first handle piece 1000 could incorporate two pin fasteners 1010 instead of one, and only one location post 1006 instead of two. Furthermore, while FIG. 10 shows location posts 1006 as part of lockbar 1002, this is not limiting. First handle piece 1000 could be constructed such that location posts 1006 are part of puck 1004, and receiving holes 1008 are part of lockbar 1002. Location posts, as well as pin fasteners described here and above with respect to FIG. 9, may be constructed from any suitable materials, including but not limited to plastic, carbon fiber, glass/other ceramics, and/or metals (e.g., steel, aluminum, titanium, etc.).

Over time, pucks, similar to those described herein, may become worn, damaged, misshapen, and/or otherwise unsuitable for use. Therefore, the fasteners described above with respect to FIGS. 9 and 10 may be constructed such that puck 812 is removably attached to the lockbar via the one or more fasteners. As a result, an individual, including a folding knife's owner, a folding knife technician/repairman/servicer, and/or other individuals, may remove an unsuitable puck from a lockbar, and replace the unsuitable puck with one more suitable for use, thereby extending the usability and/or lifespan of the folding knife.

Both single-piece and multi-piece lockbars may optionally include a stop that prevents the lockbar from being manually moved past flush with an outside surface of the handle. For example, returning to FIG. 1, lockbar 112 includes a stop 134 that is aligned with a pocket 136 in back handle 106. The position and thickness of stop 134 and the position and depth of pocket 136 are cooperatively configured so that the inside surface 138 of the lockbar can be pressed flush with the inside surface 139 of the back handle 106. However, the stop prevents the outside surface of the lockbar from being pressed past flush with the outside surface of the back handle.

Figure 11B:
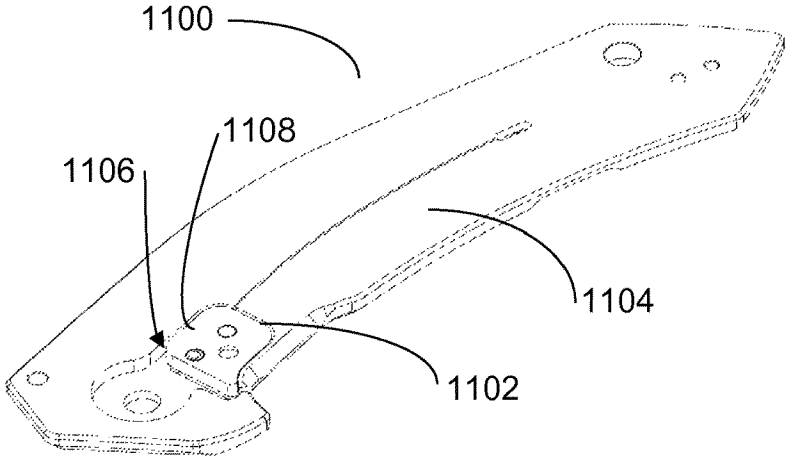
FIGS. 11A and 11B are views of an example back handle assembly in accordance with the present disclosure.
Figure 11A:
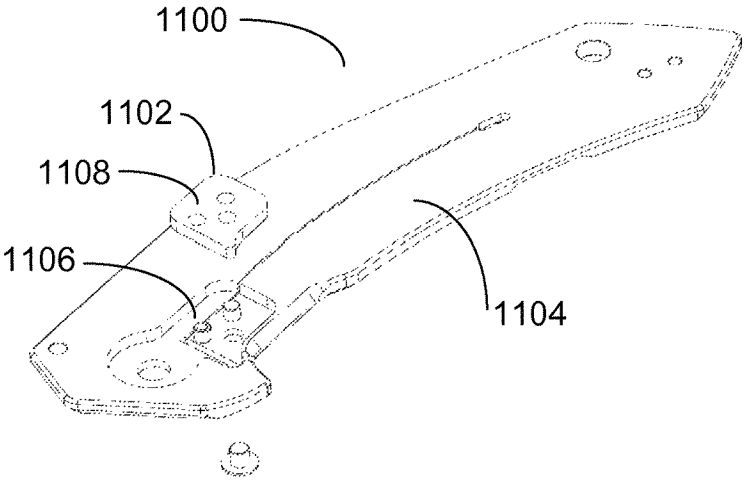

FIGS. 11A and 11B show a first handle piece 1100, including a puck 1102 and a lockbar 1104. FIG. 11A is an exploded view of first handle piece 1100, while FIG. 11B shows first handle piece 1100 after puck 1102 has been attached to lockbar 1104. Puck 1102 fits into an internal recess 1106 present on first handle piece 1100. First handle piece 1100 further includes a stop, as described above. However, in FIGS. 11A and 11B, the stop comprises a stop portion 1108 of the puck 1102. As shown, a stop portion 1108 of the puck 1102 extends past an edge of the lockbar and is aligned to engage with a recess 1106 on an internal side of the handle. If force is applied to lockbar 1104 directing it outward away from a folding plane of the blade, stop portion 1108 interfaces with internal recess 1106, such that lockbar 1104 cannot be moved past flush with first handle piece 1100 in a direction away from the folding plane of the blade. Lockbar 1104 may still be moved away from a folding plane of the blade, notably during blade closing, but only to return lockbar 1104 to a position which is parallel to the folding plane of the blade, and no further.

In some examples, a thickness of the stop portion 1108 of the puck 1102 is substantially equal to a depth of the recess 1106. As a result, an internal side of the puck 1102 is substantially flush with or recessed from the internal side of the handle and an internal side of the lockbar 1104 when the stop portion 1108 of the puck 1102 engages the recess 1106. However, the thickness of puck 1102 and the depth of recess 1106 may comprise any suitable value, and may not necessarily be equal.

Figure 12A:
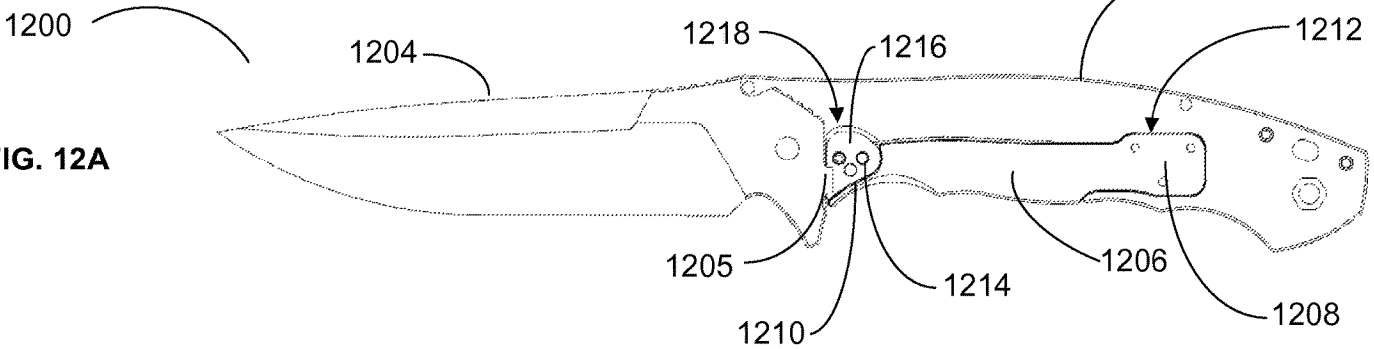
FIGS. 12A and 12B show portions of another example folding knife in accordance with another embodiment of the present disclosure.
Figure 12B:
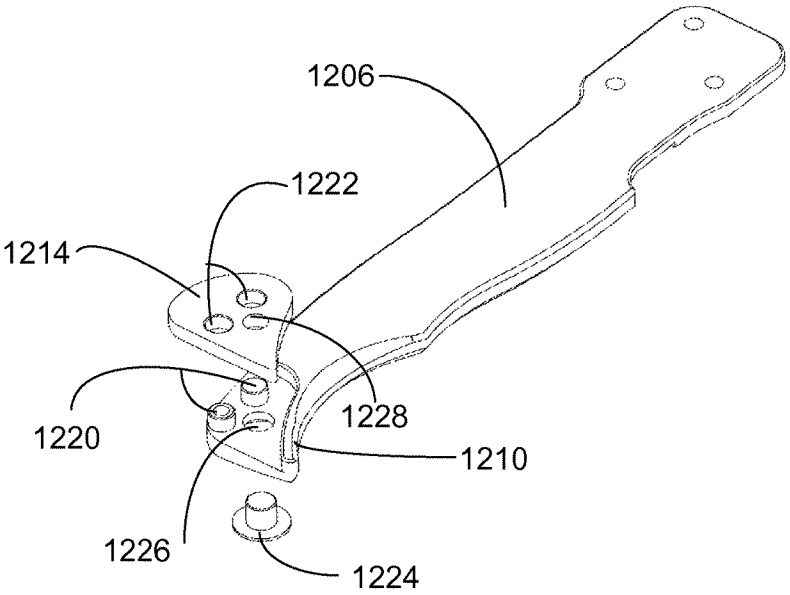

FIGS. 12A and 12B show portions of another example folding knife 1200 in accordance with the present disclosure. Folding knife 1200 includes first handle piece 1202, blade 1204, blade tang 1205, and lockbar 1206. In this example, lockbar 1206 and first handle piece 1202 are separate pieces. Lockbar 1206 includes a tail portion 1208 and a head portion 1210. In some examples, first handle piece 1202 may include a pocket 1212 which conforms to a shape of tail portion 1208, such that when lockbar 1206 is attached to first handle piece 1202, tail portion 1208 fits completely within pocket 1212, and an inner surface of lockbar 1206 is substantially flush with an inner surface of first handle piece 1202. A puck 1214 may be removably attached to head portion 1210. Lockbar 1206 may be biased toward a folding plane of the blade 1204, such that puck 1214 is configured to engage blade tang 1205 of blade 1204 in order to lock the blade in an open position. Lockbar 1206 may further include a stop, configured to limit the movement of lockbar 1206 away from the folding plane of the blade, such that lockbar 1206 can be moved out of the folding plane of the blade during blade closing, but cannot be moved past a position which is parallel to a folding plane of the blade. In this example, a stop portion 1216 of puck 1214 extends past an edge of lockbar 1206 and engages an internal recess 1218 of first handle piece 1202 when lockbar 1206 is parallel to a folding plane of the blade, comprising a stop. Lockbar 1206 can be freely moved out of the plane of the blade during blade closing, but cannot be moved past a position at which stop portion 1216 engages with internal recess 1218.

FIG. 12B shows an exploded view of lockbar 1206. In this example, head portion 1210 includes location posts 1220, and puck 1214 includes receiving holes 1222. During puck attachment, location posts 1220 may be inserted through receiving holes 1222. This embodiment may additionally include pin fastener 1224, lockbar attachment hole 1226, and puck attachment hole 1228. After location post insertion, pin fastener 1224 may be inserted through lockbar attachment hole 1226 and puck attachment hole 1228, effectively attaching puck 1214 to lockbar 1206. As with previously described embodiments, it will be appreciated that the specific arrangement of fasteners described above is not intended to limit the scope of this disclosure. Embodiments may be considered in which a puck is attached to a lockbar with greater or fewer than two location posts, more than one pin fastener, or no pin fasteners at all. It will be further appreciated that, in other embodiments, the location posts may be located on either the lockbar or the puck, and that the pin fastener may be inserted through the lockbar first and the puck second, or the puck first and the lockbar second.

Figure 13A:
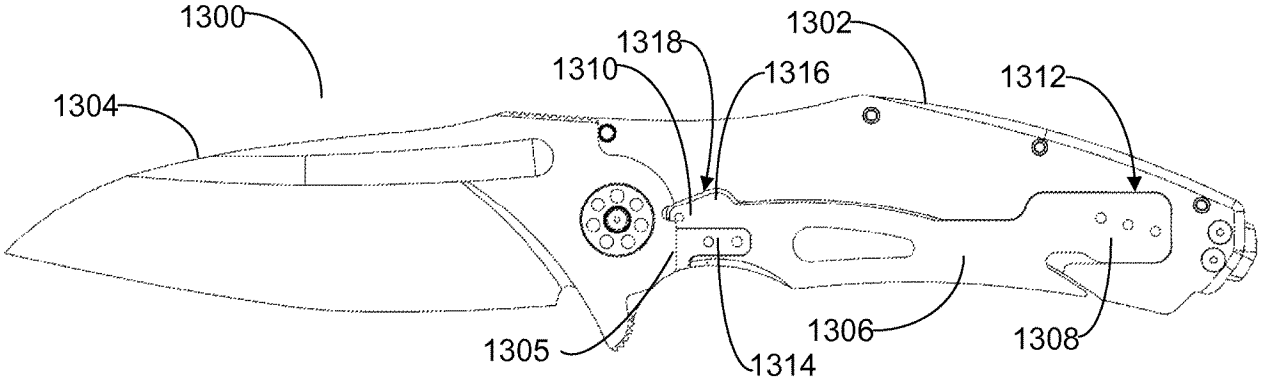
FIGS. 13A and 13B show portions of another example folding knife in accordance with another embodiment of the present disclosure.

FIG. 13A shows a portion of an example folding knife 1300 in accordance with the present disclosure. Folding knife 1300 includes a first handle piece 1302, blade 1304, blade tang 1305, and lockbar 1306. In this example, lockbar 1306 and first handle piece 1302 are separate pieces. Lockbar 1306 includes a tail portion 1308 and a head portion 1310. In some examples, first handle piece 1302 may include a pocket 1312 which conforms to a shape of tail portion 1308, such that when lockbar 1306 is attached to first handle piece 1302, tail portion 1308 fits completely within pocket 1312, and an inner surface of lockbar 1306 is substantially flush with an inner surface of first handle piece 1302. A puck 1314 may be removably attached to head portion 1310. Lockbar 1306 may be biased toward a folding plane of the blade 1304, such that puck 1314 is configured to engage blade tang 1305 of blade 1304 in order to lock the blade in an open position. Lockbar 1306 may further include a stop, configured to limit the movement of lockbar 1306 away from the folding plane of the blade, such that lockbar 1306 can be moved out of the folding plane of the blade during blade closing, but cannot be moved past a position which is parallel to a folding plane of the blade. In this example, a stop portion 1316 of lockbar 1306 engages an internal recess 1318 of first handle piece 1302 when lockbar 1306 is parallel to a folding plane of the blade, comprising a stop. Lockbar 1306 can be freely moved out of the plane of the blade during blade closing, but cannot be moved past a position at which stop portion 1316 engages with internal recess 1318.

Figure 13B:
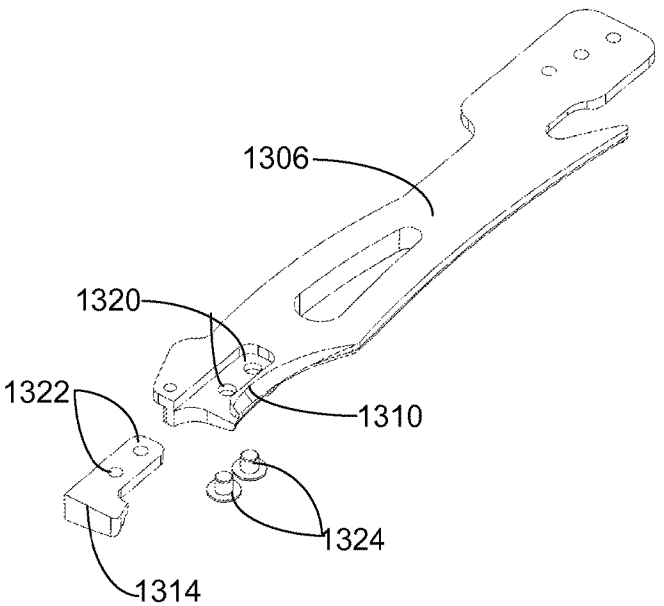

FIG. 13B shows an exploded view of lockbar 1306. In this example, head portion 1310 includes lockbar attachment holes 1320, and puck 1314 includes puck attachment holes 1322. During puck attachment, pin fasteners 1324 may be inserted through lockbar attachment holes 1320 and puck attachment holes 1322, effectively attaching puck 1314 to lockbar 1306. As with previously described embodiments, it will be appreciated that the specific arrangement of fasteners described above is not intended to limit the scope of this disclosure. Embodiments may be considered in which a puck is attached to a lockbar with greater or fewer than two pin fasteners. Additionally, one or more location posts and corresponding receiving holes could be utilized. It will be further appreciated that, in other embodiments, the pin fasteners may be inserted through the lockbar first and the puck second, or the puck first and the lockbar second.

Figure 14:
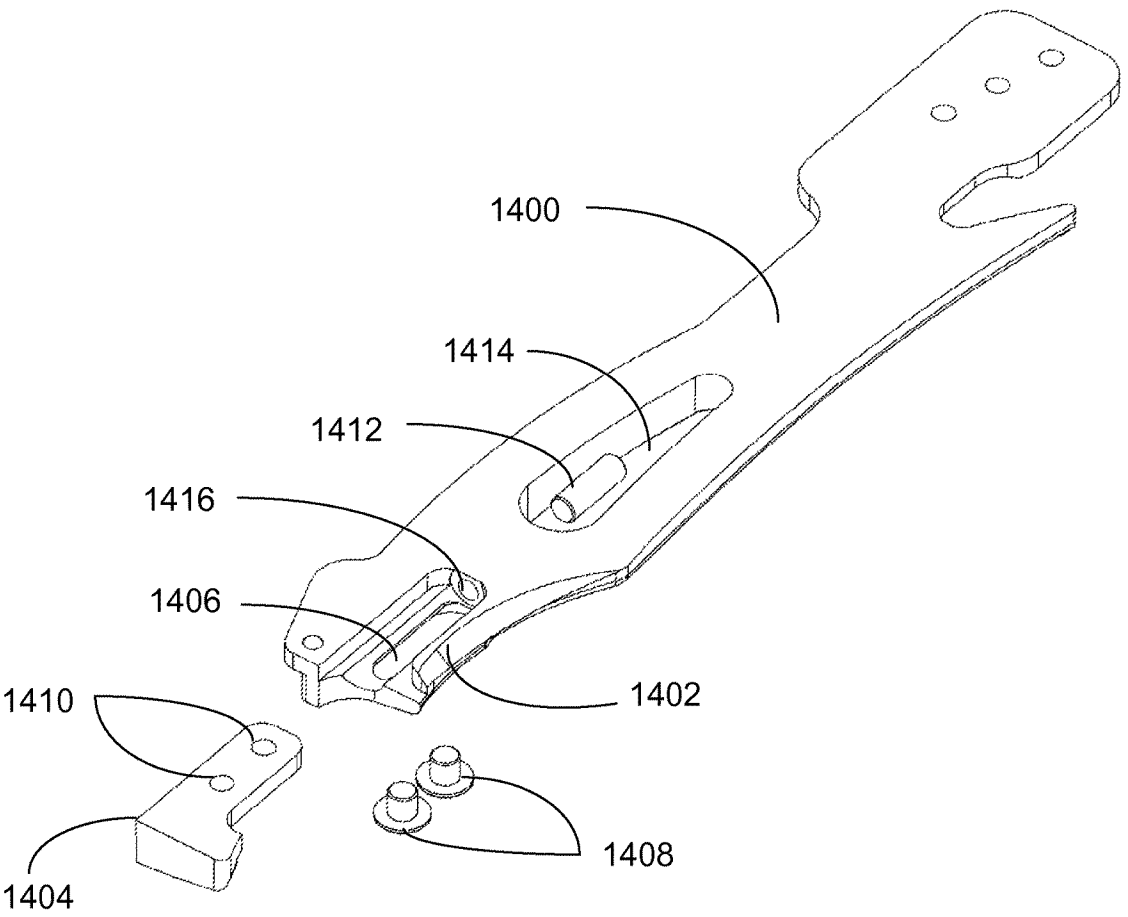
FIG. 14 is an exploded view of a portion of a back handle assembly in accordance with another embodiment of the present disclosure.

FIG. 14 shows an exploded view of an example lockbar 1400, which may in some embodiments be usable with folding knife 1300 instead of lockbar 1306. Lockbar 1400 includes head portion 1402, which may serve as an attachment site for puck 1404. In this example, puck 1404 is adjustably attached to lockbar 1400. This allows a position of puck 1404 to be tuned relative to blade tang 1405 in the event that a position of puck 1404 shifts, and/or puck 1404 becomes worn, misshapen, and/or otherwise loses its ability to interface with a blade tang. Head portion 1402 includes lockbar attachment gap 1406. During puck attachment, fasteners 1408 may be inserted through lockbar attachment gap 1406 and puck attachment holes 1410, effectively attaching puck 1404 to lockbar 1400. The position of puck 1404 relative to blade tang 1305 may be adjusted through manipulation of set screw 1412, which may be accessed through opening 1414. Manipulation of set screw 1412 may cause puck 1404 to slide in a forward direction through lockbar attachment gap 1406 toward blade tang 1405, by way of adjustment mechanism 1416, when blade 1304 is in an open position. As with previously discussed embodiments, it will be appreciated that the specific combination of fasteners described above is not intended to limit the scope of this disclosure. Alternative embodiments may be considered in which a different number of fasteners are used, or the fasteners are inserted first through the puck and second through the lockbar attachment gap.

In some embodiments, the lockbar and the blade may include corresponding components of a catch assembly that provides an initial resistance to knife opening. For example, the lockbar may include a semispherical protrusion that engages a corresponding detent on the blade when the blade is in a closed position. As another example, the lockbar may include a detent and the blade may include a semispherical protrusion. Such a detent or protrusion may be located on a single-piece lockbar or on the arm or puck of a multi-piece lockbar. FIG. 6A shows a nonlimiting example of such a protrusion 140 on lockbar 112. It is to be understood that other catch assemblies may be used without departing from the scope of this disclosure.

In some embodiments, a knife in accordance with the present disclosure may include an assisted opening mechanism. As a nonlimiting example, FIG. 1 shows a torsion spring 142 that biases the blade towards the closed position when the knife is closed or nearly closed. However, when the knife is opened past a threshold angle, the torsion spring biases the blade towards the opened position. As such, torsion spring 142 will automatically complete opening of the blade after a user manually initiates the opening.

In some embodiments, screws or other fasteners that are used to detachably connect the lockbar to the handle may be hidden by clips or other aspects of the knife. For example, FIG. 1 shows a clip 144 that hides lockbar attachment screws 146 from view.

The invention claimed is:

1. A folding knife, comprising:

a blade including a tang, the blade pivotable between open and closed positions within a folding plane of the blade;

a handle pivotably connected to the blade;

a lockbar outside the folding plane of the blade and biased toward the folding plane of the blade when the blade is in the closed position, such that the lockbar enters the folding plane of the blade when the blade is pivoted from the closed position to the open position, wherein the lockbar includes a recessed puck pocket, and wherein a thickness of the lockbar at the recessed puck pocket is non-zero and less than a thickness of the lockbar around the recessed puck pocket; and a puck fit in the recessed puck pocket and removably attached to the lockbar such that a tang-engagement portion of the puck extends past an edge of the recessed puck pocket, the puck configured to remain outside of the folding plane when the blade is in the closed position and configured such that the tang-engagement portion of the puck engages the tang to lock the blade relative to the handle in the open position.

2. The folding knife of claim 1, wherein a material of the puck is different than a material of the lockbar.

3. The folding knife of claim 2, wherein the material of the puck is harder than the material of the lockbar.

4. The folding knife of claim 2, wherein the puck is adjustably connected to the lockbar.

5. The folding knife of claim 4, further comprising a set screw to adjust a position of the puck relative to the blade.

6. The folding knife of claim 1, wherein the puck is adjustably connected to the lockbar.

7. The folding knife of claim 6, further comprising a set screw to adjust a position of the puck relative to the blade.

8. The folding knife of claim 1, wherein the handle includes a first handle piece on one side of the blade and a second handle piece on another side of the blade, and wherein the lockbar is an integral portion of the first handle piece.

9. The folding knife of claim 8, wherein the lockbar includes a puck-attachment end proximate the tang and a flexion end, opposite the puck-attachment end, and wherein the flexion end extends from a support portion of the first handle piece.

10. The folding knife of claim 1, wherein the lockbar is separate from the handle and connected to the handle.

11. The folding knife of claim 1, further comprising one or more fasteners connecting the puck to the lockbar.

12. The folding knife of claim 11, wherein the one or more fasteners include one or more pin fasteners.

13. The folding knife of claim 11, wherein the one or more fasteners include one or more location posts.

14. The folding knife of claim 11, wherein the one or more fasteners include one or more threaded fasteners.

15. The folding knife of claim 1, further comprising a stop which limits movement of the lockbar away from the folding plane of the blade.

16. The folding knife of claim 15, wherein the stop includes a stop portion of the puck extending past a support-proximate edge of the lockbar and aligned to engage with a recess on an internal side of the handle.

17. The folding knife of claim 16, wherein a thickness of the stop portion of the puck is substantially equal to a depth of the recess.

18. The folding knife of claim 17, wherein an internal side of the puck is substantially flush with or recessed from the internal side of the handle and an internal side of the lockbar when the stop portion of the puck engages the recess.

19. A folding knife, comprising:

a blade including a tang, the blade pivotable between open and closed positions within a folding plane of the blade;

a handle pivotably connected to the blade;

a lockbar outside the folding plane of the blade and biased toward the folding plane of the blade when the blade is in the closed position, such that the lockbar enters the folding plane of the blade when the blade is pivoted from the closed position to the open position, wherein the lockbar includes a recessed puck pocket, and wherein a thickness of the lockbar at the recessed puck pocket is non-zero and less than a thickness of the lockbar around the recessed puck pocket;

a puck fit in the recessed puck pocket, the puck having a harder material than a material of the lockbar; and one or more fasteners connecting the puck to the lockbar;

wherein the lockbar is configured to remain outside of the folding plane when the blade is in the closed position and bias the puck into engagement with the tang to lock the blade relative to the handle in the open position.

* * * * *